US010457453B2

(12) United States Patent
Stoneberg et al.

(10) Patent No.: US 10,457,453 B2
(45) Date of Patent: Oct. 29, 2019

(54) CHILD-RESISTANT CLOSURE SYSTEM

(71) Applicant: PHOENIX CLOSURES, INC., Naperville, IL (US)

(72) Inventors: Thomas Stoneberg, Buffalo Grove, IL (US); David Anderson, Aurora, IL (US)

(73) Assignee: PHOENIX CLOSURES, INC., Naperville, IL (US)

( * ) Notice: Subject to any disclaimer, the term of this patent is extended or adjusted under 35 U.S.C. 154(b) by 115 days.

(21) Appl. No.: 15/890,098

(22) Filed: Feb. 6, 2018

(65) Prior Publication Data

US 2019/0241330 A1 Aug. 8, 2019

(51) Int. Cl.
*B65D 50/04* (2006.01)
*B65D 53/04* (2006.01)
*B65D 41/06* (2006.01)

(52) U.S. Cl.
CPC ..... *B65D 50/043* (2013.01); *B65D 41/06* (2013.01); *B65D 53/04* (2013.01)

(58) Field of Classification Search
CPC ..... B65D 50/043; B65D 53/04; B65D 41/06
USPC ..... 215/222, 320, 332, 349–351
See application file for complete search history.

(56) References Cited

U.S. PATENT DOCUMENTS 1,669,579 A 3/1925 Scofield
2,026,889 A * 1/1936 Gray ..... B65D 41/045 215/337
2,953,272 A * 9/1960 Mumford ..... B65D 41/185 215/260
3,489,307 A * 1/1970 Wenger ..... B65D 41/045 206/807
4,485,932 A * 12/1984 Kusz ..... B65D 55/089 215/222
4,507,159 A 3/1985 Erb
4,620,640 A * 11/1986 Swartzbaugh ..... B65D 50/043 215/217
5,213,225 A 5/1993 King et al.
5,373,958 A 12/1994 Bokmiller
5,411,157 A 5/1995 King et al.
5,427,266 A * 6/1995 Yun ..... B65D 25/54 116/200
5,628,417 A 5/1997 Van Halteren
5,667,089 A * 9/1997 Moore ..... B65D 41/045 215/351
5,803,287 A 9/1998 Kusz
(Continued)

*Primary Examiner* — James N Smalley
(74) *Attorney, Agent, or Firm* — Husch Blackwell LLP

(57) ABSTRACT

The invention relates to child-resistant closure systems including a container, closure, and a resilient deformable liner positioned therebetween. The container and closure include mechanisms for engaging each other when the closure system adopts a closed configuration. In the closed configuration, the liner adopts a moderately non-flat profile and covers a mouth of the container. The closure can include a deflection rib and a highly curved top panel; when a pushing movement of sufficient force is applied to the closure, the closure system transitions from the locked configuration to an unlocked configuration. At this time, the deflection rib deforms a central portion of the liner, and the highly curved portion of the top panel engages the mouth of the container; this action can cause an outer portion of the liner to contact the highly curved portion and transition to a highly curved profile mimicking the profile of the top panel.

20 Claims, 8 Drawing Sheets

(56) References Cited

U.S. PATENT DOCUMENTS

| | | | | |
|---|---|---|---|---|
| 5,927,532 | A * | 7/1999 | Traub | B65D 41/06 215/222 |
| 6,044,994 | A * | 4/2000 | Miller | B65D 41/045 215/341 |
| 7,380,678 | B1 * | 6/2008 | Johnsen | B65D 41/045 215/262 |
| 7,527,159 | B2 | 5/2009 | Brozell | |
| 8,608,002 | B2 | 12/2013 | Hennebelle | |
| 2017/0001763 | A1 * | 1/2017 | Hu | B65D 41/045 |

* cited by examiner

CHILD-RESISTANT CLOSURE SYSTEM

BACKGROUND OF THE INVENTION

There is a need for closure systems that can prevent young children from being able to inadvertently open the bottle to use or ingest the contents, while still being readily opened by the efforts of mature adults.

This invention relates to child-resistant closure systems including a container, a closure, and a resilient deformable liner interposed between the container and the closure. The invention particularly relates to a closure system that can adopt a locked configuration in which the resilient deformable liner can adopt a flat configuration to align the container and closure with respect to each other. When transitioning from the locked to an unlocked configuration, sufficient directional force can be applied to the closure system to cause the liner to deform, thus allowing the locking structures of the container and closure to disengage and separate.

BRIEF SUMMARY OF THE INVENTION

This invention generally relates to a child-resistant closure system including a container, a closure, and a liner. The container includes a body for holding a flowable material and a mouth for dispensing the flowable material. The container and the closure each have structures that allow them to lockingly engage each other; when the locking mechanism of the container engages the locking mechanism of the closure, the closure system adopts a closed or locked configuration that is resistant to casual or unsophisticated efforts at opening the closure system.

When the closure is in the locked configuration, the thickness of the resilient deformable liner can act as a spacing element between the container and the closure, orienting the container and closure with respect to each other. In this configuration, the resilient deformable liner can form a sealing engagement against the mouth of the container.

To move from the locked configuration to an unlocked configuration, the closure is pushed toward the container. If the container and closures are pushed toward each other for a sufficient distance, an interior structure of the closure can cause a central portion of the resilient deformable liner to change its shape from a moderately non-flat profile to a twisting, sinuous profile. This change allows the closure to move closer to the container, allowing the locking mechanisms of the container and the closure to disengage.

The invention particularly relates to a child-resistant closure system including a) a container having i) a neck on a first end of the container, the neck having a finished edge defining an annular mouth, and ii) a plurality of spaced-apart projections extending outward from an outer surface of the neck, each neck projection including a hook-shaped portion defining a notch in the interior of the projection, a portion of each notch adjoining a narrower end of a tapering passageway; b) a closure having a i) top panel and a ii) skirt depending from a periphery of the top panel, the top panel including a central portion, an annular depressed portion surrounding the central portion, and an annular raised portion surrounding the depressed portion, the central portion having an annular deflection rib extending inward from an interior surface of the central portion; the closure skirt having, respectively, a first portion communicating with the top panel, the first portion containing a plurality of spaced-apart liner retainers extending inward from an interior surface of the first portion, each liner retainer defining a ledge, a second portion containing a plurality of spaced-apart lugs extending inward from the interior surface of the central portion, the lugs adapted to engage the notches in the projections on the container, and a peripheral rim; and c) a resilient deformable liner positioned between the container and the closure, having: i) an interior portion communicating with the annular deflection rib, ii) an exterior portion communicating with the finished edge of the container neck, and iii) a peripheral edge communicating with the liner retainers; such that when the closure system is in a locked configuration, the lugs are engaged within the notches in the projections on the container, and the resilient deformable liner adopts a moderately non-flat profile and sealingly engages the finished edge; and such that when in the locked configuration, when sufficient force is applied for the top panel and the finished edge to engage the resilient deformable liner therebetween, the resilient deformable liner is increasingly deformed as it contacts the depressed and raised portions of the top panel, and the lugs can exit the notches through the tapering passageways.

An aspect of the invention can include the first portion of the closure skirt comprising a plurality of stop ribs extending inward from the interior surface of the first portion, each stop rib communicating with a corresponding projection when the closure system is in the locked configuration.

An aspect of the invention can include the finished edge angling inward and toward the closure.

An aspect of the invention can include the angle between the finished edge and the neck being less than 45 degrees.

An aspect of the invention can include the liner retainers extending inward from the closure skirt for a distance between 1/64 of an inch and 4/64 of an inch.

An aspect of the invention can include the closure system being manufactured by blow molding.

An aspect of the invention can include the annular deflection rib defining a ring surrounding the central portion, and a diameter of the deflection rib being smaller than a diameter of the mouth of the container.

The invention also relates to a child-resistant closure system including: a) a container having: i) a mouth, the mouth surrounded by a finished edge, and ii) a plurality of spaced-apart projections extending outward from an outer surface of the container, each projection having: an interior surface defining a notch within the projection, and an exterior surface defining a side of a tapering passageway, the tapering passageway connecting the notch to an exterior surface of the projection; b) a closure having i) a top panel and ii) a skirt depending from a periphery of the top panel, the top panel including a central portion, a groove disposed around the central portion, and a ridge disposed around the concave portion, the central portion having an deflection rib extending inward from an interior surface of the central portion; the closure skirt having: a first portion containing: a plurality of spaced-apart liner retainers extending inward from an interior surface of closure skirt, and a plurality of stop ribs extending inward from the interior surface of the first portion, each stop rib for communicating with a corresponding projection when the closure system is in a locked configuration; a second portion containing a plurality of spaced-apart lugs extending inward from the interior surface of the central portion, the lugs adapted to engage the notches in the projections on the container; and c) a resilient deformable liner positioned between the container and the closure having, respectively: i) an first surface contacting the deflection rib, ii) a second surface contacting the finished edge of the container, and iii) a peripheral edge communicating with the interior surface of the closure skirt; such that when the closure system adopts the locked configuration, the lugs are engaged within the notches in the projections on the container, and the liner contacts the closure only or primarily at the deflection rib; and such that when the closure system adopts an unlocked configuration by a pushing movement applied to the closure so that the peripheral edge and the ridge engage the resilient deformable liner therebetween, the pushing engagement causing: the deflection rib to deform a central portion of the deformable liner, the peripheral edge of the resilient deformable liner to disengage or become more distant from the liner retainers, and a portion of the liner to contact the raised and depressed portions of the closure; and the pushing movement allowing the lugs to disengage from the notches through the tapering passageways for separating the closure from the container.

An aspect of the invention can include the finished edge including an angled upper surface having an inner edge and an outer edge, the inner edge of the angled upper surface contacting the resilient deformable liner when the closure system is in the locked configuration, and both edges contacting the resilient deformable liner when the closure system adopts the unlocked configuration.

An aspect of the invention can include the finished edge forming an acute angle in relation to a plane defined by the mouth.

An aspect of the invention can include: the deflection rib defining a ring surrounding a center of the central portion; and a diameter of the deflection rib being smaller than a diameter of the mouth of the container.

An aspect of the invention can include the liner retainers extending inward from the closure skirt for a distance between 1/64 of an inch and 4/64 of an inch.

An aspect of the invention can include the closure system being manufactured by blow molding.

An aspect of the invention can include, when the closure system transitions from the locked configuration to the unlocked configuration, the resilient deformable liner adopting a profile with multiple curves.

The invention also relates to: a) a container having: a mouth defined by a finished edge, and a plurality of spaced-apart projections extending outward from an outer surface of the container, each projection defining an indentation; b) a closure having a top panel and a skirt depending from a periphery of the top panel, the top panel including a central portion, a concave portion disposed around the central portion, and a convex portion disposed around the concave portion, the central portion having an deflection rib extending inward from an interior surface of the central portion; the closure skirt having: a first portion communicating with the top panel, the first portion containing a plurality of spaced-apart circumferential liner retainers extending inward from an interior surface of closure skirt, and a second portion containing a plurality of spaced-apart circumferential lugs extending inward from the interior surface of the central portion, the lugs adapted to engage the indentations in the projections on the container; and c) a resilient deformable liner positioned between the container and the closure having: a first surface facing the top panel, a second surface facing the mouth of the container, and a peripheral edge extending past the mouth; such that when the closure system is in a locked configuration, the lugs are engaged within the indentations in the projections on the container, the first surface contacts the deflection rib, and the peripheral edge no longer engages the liner retainers; and such that the closure system transitions from the locked configuration to an unlocked configuration by moving the top panel toward finished edge for a transition distance, so that a) the deflection rib moves a central portion of the resilient deformable liner into the mouth of the container, b) the resilient deformable liner becomes more distant or disengages from the liner retainers, c) a portion of the resilient deformable liner contacts the concave and convex portions of the closure; and d) the lugs move from the indentations to the tapering passageways, for disengaging the closure from the container.

An aspect of the invention can include the finished edge including an angled surface having an inner edge and an outer edge, the inner edge of the angled upper surface contacting the resilient deformable liner when the closure system is in the locked configuration, and both edges contacting the resilient deformable liner when the closure system adopts the unlocked configuration.

An aspect of the invention can include, when in the locked configuration, the liner retainers do not contact the mouth of the container.

An aspect of the invention can include when the closure system is in the locked configuration, the resilient deformable liner adopts a flat configuration.

An aspect of the invention can include the deflection rib defining a ring surrounding a center of the central portion.

An aspect of the invention can include the first portion of the closure skirt comprising a plurality of stop ribs extending from the interior surface of the first portion, each stop rib communicating with a corresponding projection when the closure system is in the locked configuration, and each stop rib disengaging from the corresponding projection when the closure system is in the unlocked configuration.

An aspect of the invention can include the indentations having a height and a length; and the transition distance being greater or equal to the indentation height.

A more detailed explanation of the invention is provided in the following description and claims and is illustrated in the accompanying drawings.

BRIEF DESCRIPTION OF THE FIGURES

The accompanying drawings illustrate the present invention and together with the description, further serve to explain the principles of the invention and to enable a person skilled in the relevant art to make and use the invention.

These and other features and advantages of the present invention will be apparent from the following detailed description, claims, and accompanying drawings.

DETAILED DESCRIPTION OF THE INVENTION

Figure 1:
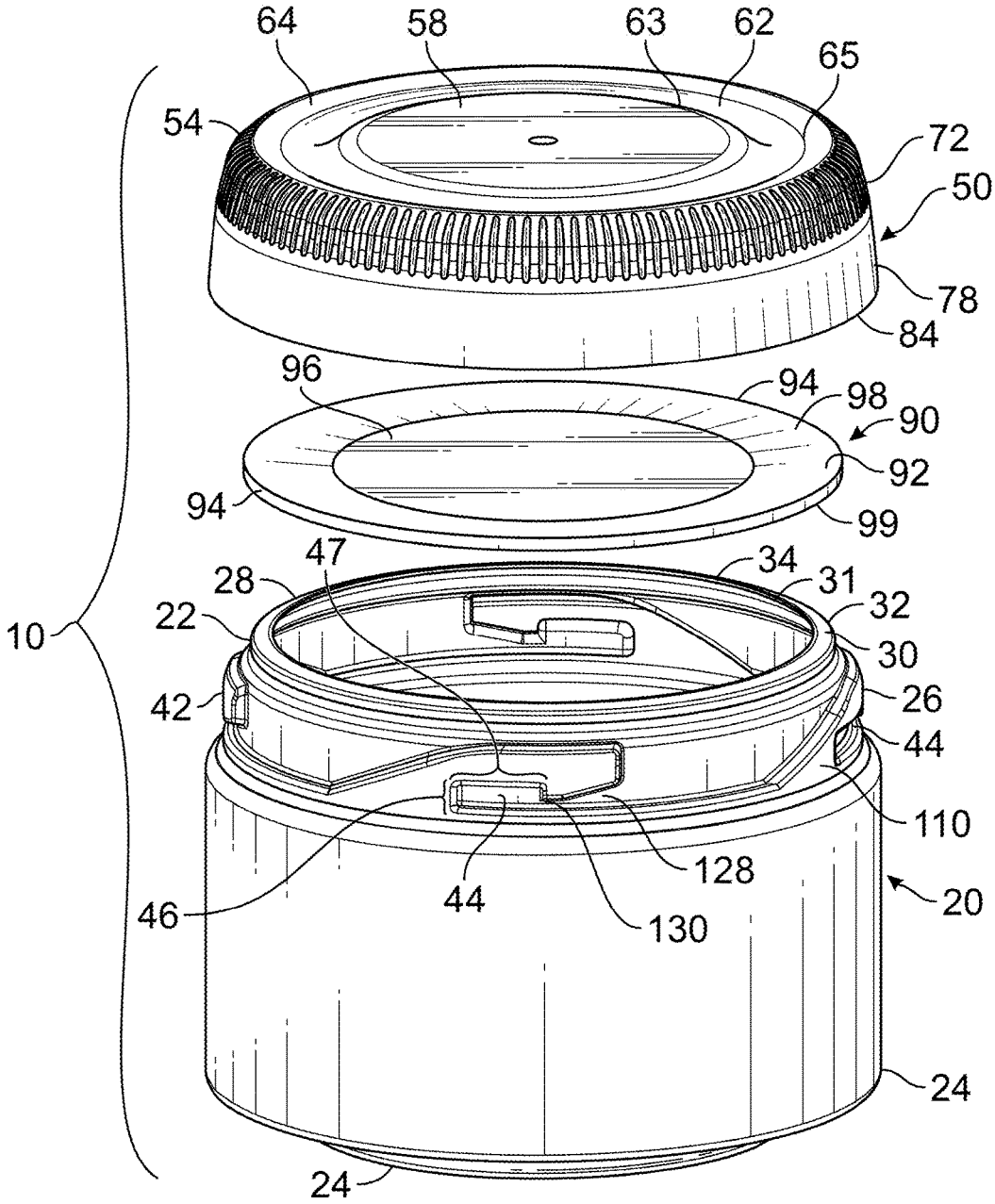
FIG. 1 shows an exploded, perspective view of the parts of an embodiment of a child-resistant closure system.

While this invention is susceptible of embodiments in many different forms, there are shown in the drawings and will be described in detail herein specific embodiments with the understanding that the present disclosure is to be considered as an exemplification of the principles of the invention. It is not intended to limit the invention to the specific illustrated embodiment.

The features of the invention disclosed herein in the description, drawings, and claims can be significant, both individually and in any desired combinations, for the operation of the invention in its various embodiments. Features from one embodiment can be used in other embodiments of the invention.

It should be further understood that the title of this section of this specification, namely, "Detailed Description of The Invention," relates to a requirement of the United States Patent & Trademark Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Referring to FIGS. 1-9, embodiments of a child-resistant closure system are shown in accordance with the present invention. The invention relates to closure system including a container, a closure, and a liner positioned between the container and the closure, to provide a sealing, child-resistant closure system.

Referring to FIG. 1, the child-resistant closure system 10 includes a container 20, a closure 50, and a resilient deformable liner 90 positioned between the container 20 and the closure 50.

Container

A container 20 can include a body portion 21 for holding a flowable material, the body portion 21 bounded by a container wall 23 having a top end 22 and a bottom end 24 on opposite sides of the container 20. The top end 22 can include a neck 26. As shown in FIG. 1, the container 20 can have a cylindrical or tubular body portion 21, and the neck 26 can have cylindrical or tubular shape with a smaller diameter or circumference than the body portion 21.

The top end 22 can include a mouth 34 or opening for dispensing the flowable material into and/or out of the container 20. In embodiments having a neck 26, the mouth 34 can be disposed at an end of the neck 26; in neckless embodiments, the mouth 34 can be located on the top end 22 of the container 20. The container mouth 34 can include a finished edge 28 defining or outlining the mouth 34 (or outlining the opening bounded by the mouth 34) or the end of the neck 26.

Figure 5A:
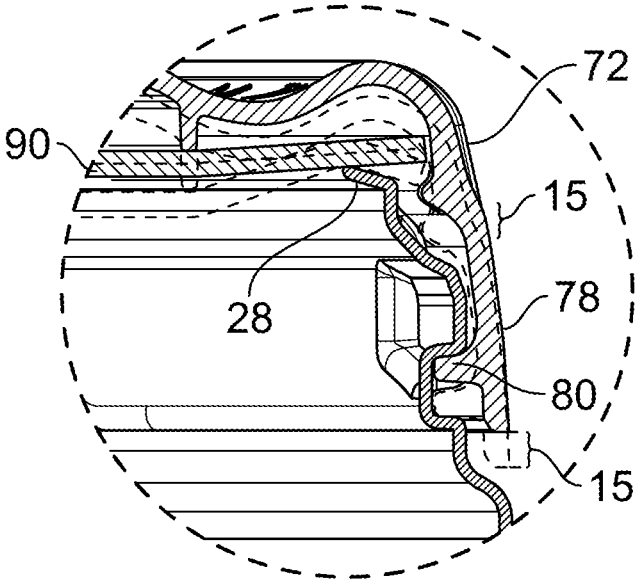
FIGS. 5A-5C show an enlarged cross-sectional portion of FIG. 3, with the closure system transitioning to an unlocked configuration.
Figure 5B:
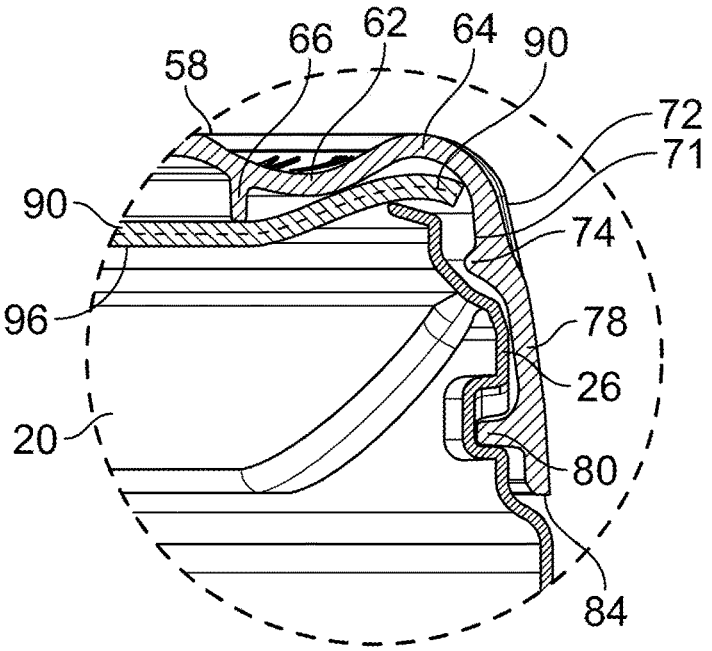
Figure 5C:
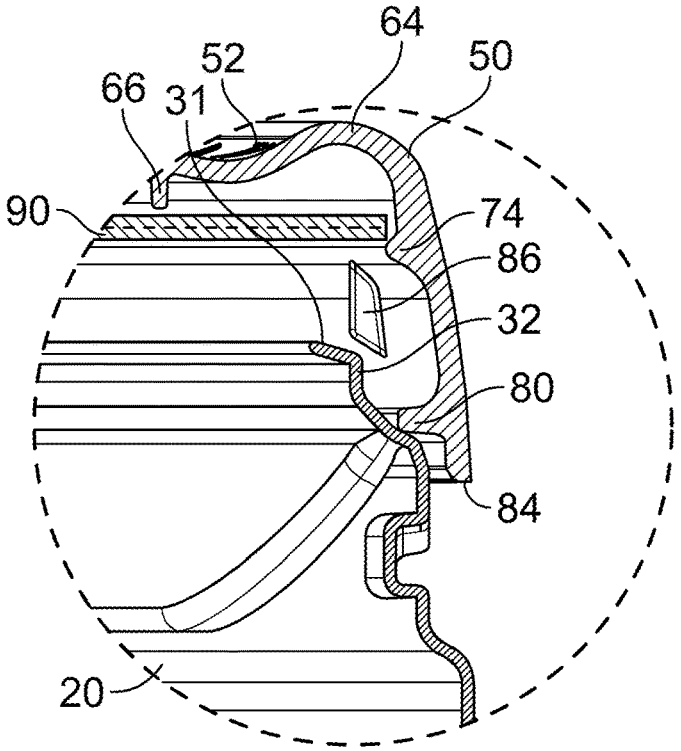

The finished edge 28 of the mouth 34 can include a rim or boundary 30 that preferably faces away from the bottom end 24 of the container 20. When the closure system 10 is in a locked configuration, that boundary 30 can face the resilient deformable liner 90 and/or a top panel 52 of the associated closure 50. The finished edge boundary 30 can be an outward-facing surface that is smooth, convex, concave, or textured. As shown in FIGS. 1 and 5, where the mouth 34 is round or circular in shape, the finished edge boundary 30 can describe a ring-shaped or annular structure with a flat, planar surface, giving the mouth 34 a circular, ring-shaped, or annular outline. The mouth 34 can surround or define a hole or opening that provides access to the interior of the container 20.

The boundary 30 can include a surface having an outer edge 32 where the boundary 30 joins the top end 22 or the neck 26 of the container 20. The outer edge 32 can define an outer perimeter of the boundary 30, which in turn can define the outer perimeter of the mouth 34.

The boundary 30 surface can have an inner edge 31 where the boundary ends or terminates and defines the mouth 34. The inner edge 31 can define an inner perimeter of the boundary 30. As shown in FIGS. 1 and 5, the boundary 30 can define an upward-sloping surface; that is, a surface that angles inward toward a central longitudinal axis of the container 20 and angles away from the bottom end 24 of the container 20. In a closure system 10 in the closed configuration, the boundary 30 can angle inward and upward toward a center or central portion 58 of the top panel 52 of the closure 50. The angle between the finished edge 28 and the top end 22 of the container 20 is preferably between 1-90 degrees, 1-15 degrees, 15-75 degrees, 30-60 degrees, or 40-50 degrees. It is preferred that this angle be an acute angle. In other embodiments, the angle cans an obtuse angle, greater than 90 degrees, between 91-180 degrees, 105-165 degrees, 120-140 degrees or about 135 degrees.

The outer surface 40 of the container 20 can include one or more structures for engaging the closure 50 and for placing the closure system 10 into a closed configuration.

The top end 22 of the container 20 can include, on its outer surface 40, one or more structures projecting outward from the outer surface 40, each projection 42 including inside it a notch 44 or indentation for engaging a corresponding locking structure on the closure 50. Where the container 20 has a neck 26, the projections 42 can be located on the neck 26 of the container 20.

As shown in FIGS. 1, 6, and 8-9, a plurality of projections 42 can be arranged around a circumference of the outer surface 40 of the container 20; preferably, the projections 42 can be regularly- or equally-spaced apart around the container 20. Particularly, the projections 42 can be regularly spread out or spaced around a plane defined by the projections 42. Such a plane can be perpendicular to a central longitudinal axis of the container 20 and/or parallel to the bottom or top ends 22, 24 of the container 20. Such a plane can be perpendicular to the top panel 52 of the closure 50 when the closure system 10 is in the locked configuration. The projections 42 can have an axial arrangement around the container 20.

Each projection 42 can include a base 110 attached or connected to the top end 22 of the container 20. The base 110 can extend upward toward the mouth 34 of the container 20 and extend into a hooked portion 112, the hook-shaped portion running parallel to the mouth 34 of the container 20. The outer edge 114 of the hooked portion 112 can face toward the mouth 34 of the container 20, while the inner edge 116 of the hooked portion 112 can face away from the mouth 34 of the container 20. The outer and inner edges 114, 116 of the hooked portion 112 can meet at an outer tip 118 of the hooked portion 112. The outer edge 114 of the hooked portion 112 does not contact the mouth 34 in preferred embodiments. The inner edge 116 of the hooked portion 112 can surround a portion of the periphery 49 of the notch 44. The bottom edge of the notch 44 can be defined by a shelf 122 that extends from one end (or other portion) of the notch 44 to the base 110 of a neighboring projection 42.

Each projection 42 can be connected to its neighboring projection 42 by the shelf 122, the shelf 122 defining a flat surface on the outer surface 40 of the container 20; preferably, the flat surface is oriented to be substantially perpendicular to the container wall 23.

The shelf 122 can have a first segment 124 that defines a side or edge of the notch 44. The shelf 122 can have a second segment 125 that defines a side or edge of a tapering passageway 128. The shelf 122 can have a third segment 126 that extends to and joins the base 110 of a neighboring projection 42. These first, second, and third segments 124, 125, 126, can directly connect to each other, respectively, or can have additional segments between them or flanking them. As shown in FIGS. 1, 6, and 8-9, the narrowest portion or end 130 of the tapering passageway 128 can communicate with the notch 44 where the first and second segments 124, 125 of the shelf 122 meet. As shown in FIGS. 1, 6, and 8-9, the narrowest portion or end 130 of the tapering passageway 128 can communicate with the notch edge or corner 48 that is furthest from the mouth 34 of the container 20.

The shelf segments can define a shelf 122 that defines a straight or linear path between projections 42. The shelf 122 can define a curved, angled, or rippled path between the projections 42. It is preferred that the surface defined by the shelf 122 faces away from the bottom end 24 of the container 20 (or toward the mouth 34 of the container 20).

In preferred embodiments, each projection 42 can have an outer surface that follows the curvature of the container 20 and/or the mouth 34.

Each projection 42 can abut or adjoin an inwardly-tapering passageway 128 leading to the notch 44, the notch 44 being located within the projection 42. Preferably, the inwardly-tapering passageways 128 are oriented in the same direction, with respect to each other, and each inwardly tapering passageway 128 terminates with its narrower, tapering end 130 leading into the locking notch 44. The narrowest ends 130 can lead to a corner 48 or portion of the notch 44 closest to the bottom end 24 of the container 20 (or furthest from the top end 22 of the container 20).

A portion of the base 110 can define an edge or side of the notch 44 at the location where the base 110 meets the first segment 124 of the shelf 122. For example, the base 110 can define a wall or surface that is substantially orthogonal to notch 44 and/or the neck 26; this stopping surface 119 can stop the movement of a lug 80 when a lug 80 becomes engaged within a notch 44, particularly when the closure 50 engages the container 20. As an alternative, the base 110 can define a wall or surface that slopes from the projecting surface of the base 110 to the recessed surface of the indentation or notch 44; this non-stopping surface can allow the corresponding lug 80 to exit the notch 44.

All of the notches 44 of a container 20 can all have stopping surfaces 119. All of the notches 44 of a container 20 can all have non-stopping surfaces 129. In some embodiments, some of the notches can have a stopping surface 119, while other notches have a non-stopping surface 129.

Figure 6:
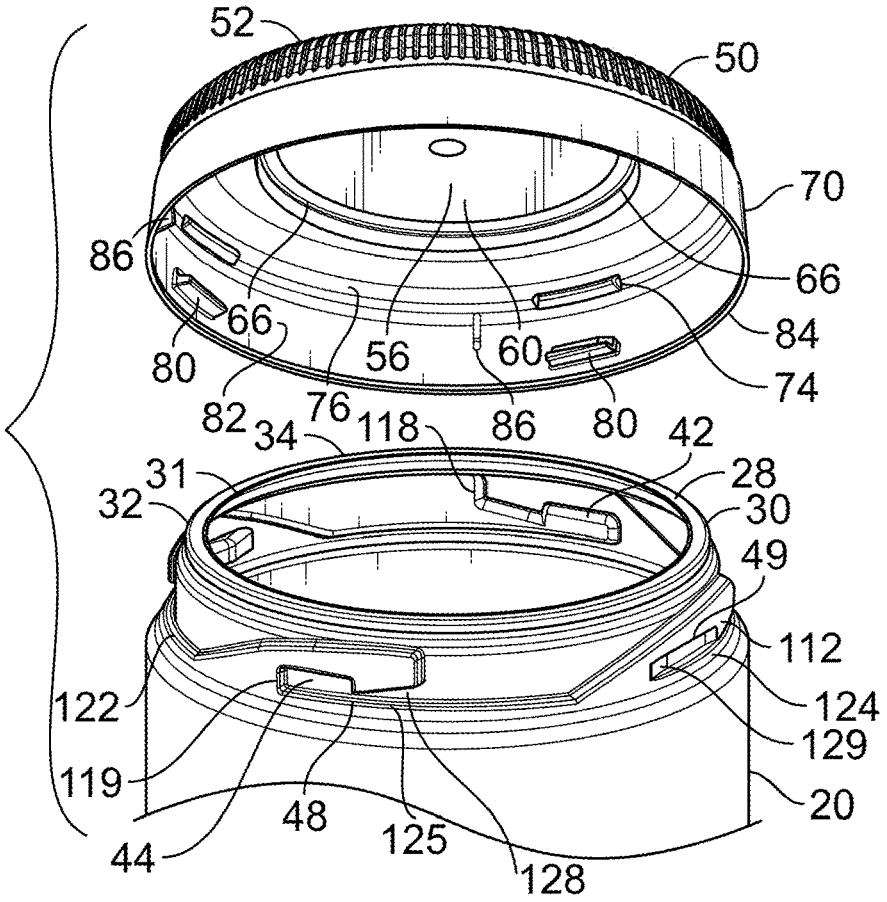
FIG. 6 shows an exploded perspective view of the closure and container components of a closure system.

As shown in FIGS. 1 and 6, the peripheries 49 of the notches 44 are defined by the shelf 122 (e.g. the first segment of the shelf 124), the inner edge 116 of the projection 42 hooking portion 112, and narrowest portion 130 of the tapering passageway 128. The locking notches 44 can have a generally rectangular appearance defined by a height 46 and a length 47. Other locking notches 44 can have square, round, oval, or other-shaped outlines or shapes. One edge or corner 48 or portion of each notch 44 can connect to or communicate with the narrowest end 130 of the tapering passageway 128, the passageway 128 then widening as it moves away from the notch 44. While one side of the tapering passageway 128 can define a portion of the shelf 122, the other side of the tapering passageway 128 can define a portion of the inner edge 116 of the hooked portion 112, between the tip 118 and the notch 44.

Closure

Figure 3:
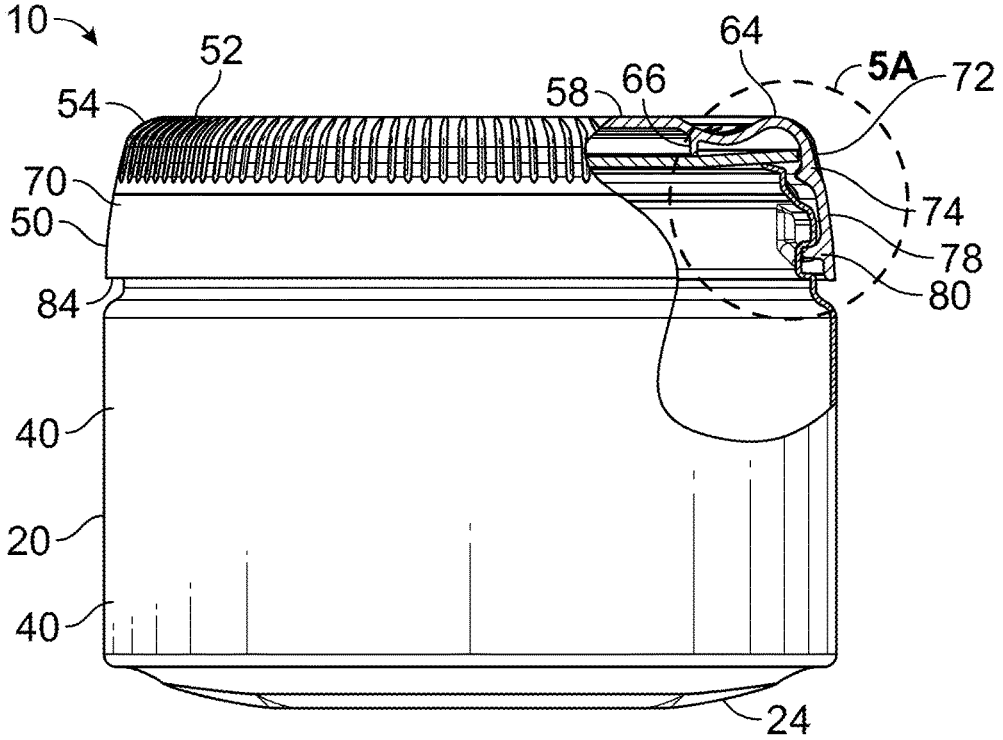
FIG. 3 shows a side view of a child-resistant closure system, with a cross-sectional portion exposed to view.
Figure 4:
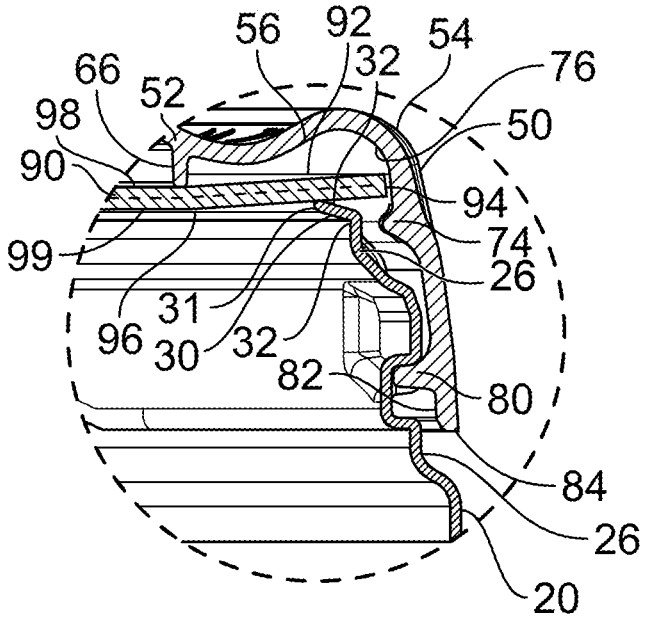
FIG. 4 shows an enlarged cross-sectional portion of FIG. 3, with the closure system in a locked configuration.
Figure 7:
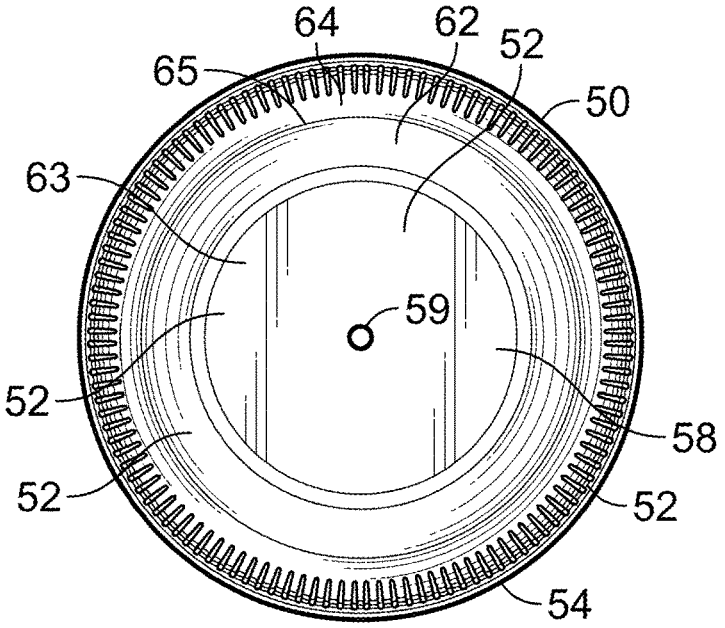
FIG. 7 shows an overhead view of a closure system.

The closure 50 can include a top panel 52 and a skirt 70 depending from a peripheral edge 54 of the top panel 52. Preferably, the top panel 52 is positioned substantially perpendicular to the top panel 52. The top panel 52 can define a generally flat surface. The center of the top panel 52 can be located in a central portion 58 of the top panel 52; the central portion 58 can be surrounded by portions having different elevations than the central portion 58. As shown in FIGS. 1, 4, and 5, the central portion 58 can be surrounded or bounded by a portion 62 that is depressed in elevation (when compared to the central portion 58). The depressed portion 62 can be surrounded or bounded by a portion 64 that has a raised or heightened elevation compared to the depressed portion 62. The raised or elevated portion 64 can have an elevation higher than, lower than, or equal to the central portion 58. The raised portion 64 can be surrounded or bounded by the periphery 54 of the top panel 52. The central, depressed, and raised portions 58, 62, 64 can directly each other, respectively, or be separated by additional portions in the top panel 52.

Where the closure 50 is round or circular in shape, the central portion 58 can include a circular or round central region of the top panel 52. As shown in FIG. 7, each of the depressed portions 62, raised portion 64, and periphery 54, respectively, can define rings or annular structures disposed concentrically around the central portion 58. While the central portion 58 can be flat, as shown in FIG. 3, the central portion 58 can also be concave, convex, angled, contoured or textured.

When viewed in cross-section, as shown in FIGS. 4-5, the top panel 52 of the closure 50 can include a central portion 58 neighbored or flanked or enclosed in a convex portion 62, which is in turn neighbored or flanked or enclosed by a concave portion 64. In other words, the exterior edge 61 of the central portion 58 can be bordered by a depression or valley or groove 62, with the exterior edge 63 of the depression 62 bordered by a ridge or peak 64. The neighboring inner concave portion 64 and outer convex portion 62, when viewed together, can define a sinuous, snakelike structure, giving the profile of the top panel 52 an outer portion with a marked ripple or multiple curves resembling a sine wave. While a twisting or flowing profile with smooth curves is shown in FIG. 5, the convex and concave portions 62, 64 can instead define angled surfaces with points or curves at their apexes.

In preferred embodiments, the profiles defined by the depressed and raised portions 62, 64 of the top panel 52 can appear twisting, snaking, rippled, S-shaped, or S-curved.

As shown in FIGS. 4-6, the top panel 52 can include a deflection rib 66, a projection 42 that extends from the inner surface 55 of the top panel 52 and surrounds a portion of the top panel 52. It is preferred that the deflection rib 66 surrounds or encases part or all of the interior surface 56 of the central portion 58 of the top panel 52. It is more preferred that the deflection rib 66 surround or border the center 59 of the central portion 58, with the center 59 of the central portion 58 also defining the center of the deflection rib 66 on a central longitudinal axis of the closure system 10.

Where the closure 50 is round or oval, the deflection rib 66 can define an annular ring or oval ridge around part or the entire central portion 58. It is preferred that the deflection rib 66 contact the interior surface 60 of the central portion 58 and/or depressed portion 62 of the top panel 52, but not the raised portion 64 of the top panel 52. As shown in FIG. 6, where the closure 50 and the container 20, it is preferred that the deflection rib 66 have a smaller diameter or circumference than the finished edge 28 of the mouth 34 of the container 20. It is further preferred that the deflection rib 66 does not contact the finished edge 28 when the closure system 10 is in the locked configuration; that is, that the deflection rib 66 is offset from the finished edge 28.

As shown in FIGS. 1, 4-5, and 7, the closure 50 can include a skirt 70 depending substantially perpendicular from the outer edge or periphery 54 of the top panel 52. From the location where the closure skirt 70 joins the top panel 52, the closure skirt 70 can include, respectively, a first portion 72, a second portion 78, and a peripheral rim 84 at its terminus. The first portion 72 can surround or encircle the periphery 54 of the top panel 52, while the second portion 78 can define a zone abutting the bottom edge of the closure skirt 70.

When the closure 50 is engaged with the container 20, the closure skirt 70 can surround or encircle the outer surface 40 of the top end 22 and/or the neck 26 of the container 20.

The first portion 72 of the closure skirt 70 can include one or more liner retainers 74, the liner retainers 74 being structures that extend or protrude inward from the interior surface 76 of the first portion 72. Each liner retainer 74 can define a structure resembling a ledge, a shallow inward projection or extension, with the ledge oriented to be substantially parallel to the top panel 52 and/or peripheral rim 84 of the closure skirt 70. The liner retainers 74 can define flat or substantially flat surfaces facing toward and/or away from the top panel 52. The liner retainers 74 can include surfaces that are curved or angled or define a projection or extension that is triangular in cross-section. The liner retainer 74 can function to engage the resilient deformable liner 90 when the closure system 10 is in the locked configuration.

It is preferred that the liner retainers 74 engage the peripheral edge 94 of the resilient deformable liner 90 and engage a lesser portion of the exterior portion 92 of the resilient deformable liner 90.

In preferred embodiments, the liner retainers 74 can extend inward for relatively short distances, preferably less than 1 inch, less than 32/64 of an inch, less than 24/64 of an inch, less than 16/64 of an inch, or between 8/64 of an inch and 40/64 of an inch, 16/64 of an inch and 32/64 of an inch, or around 20/64 of an inch, about 1/64 to 4/64 of an inch. In more particularly preferred embodiments, the liner retainers can 74 extend inward for a distance between 0.0015625 to 0.06250 inches, or about 0.030 inches.

The liner retainers 74 can be regularly- or equally-spaced apart around the interior of the first portion 72. It is preferred that the liner retainers 74 define a plane that is parallel to the top panel 52 of the closure 50 and/or the peripheral rim 84 of the closure skirt 70.

As shown in FIGS. 4-5, the container 20 can be contoured to facilitate the downward movement of the liner retainers 74. When viewed in profile, the container's widest circumference of diameter can be found in the bottom end 24 of the container 20, with the top portion 22 tapering inward to define a mouth 34 with a smaller circumference or diameter. The top end 22 of the container 20 can be contoured to allow the liner retainers 74 to communicate with a portion of the top end 22 extending inward from the mouth 34.

The second portion 78 of the closure skirt 70 can include one or more lugs 80, extensions or protrusions from the interior surface 82 of the second portion 78. Each lug 80 can define a structure with a shallow inward projection or extension, resembling a ledge oriented to be substantially parallel to the top panel 52 and/or peripheral rim 84 of the closure skirt 70. The lugs 80 can define flat or substantially flat surfaces facing away from the closure skirt 70. The lugs 80 can include surfaces that are curved or angled or have a triangular profile in cross-section. The lugs 80 can function as locking mechanisms to engage the locking mechanisms of the container 20 when the closure system 10 is in the locked configuration.

The plurality of liner retainers 74 and the plurality of lugs 80 can define planes that are parallel to each other. The liner retainers 74 and/or the lugs 80 can be disposed axially around the interior surface 71 of the closure skirt 70. The liner retainers 74 and/or the lugs 80 can be can be arranged around a circumference of the interior surface 71 of the closure skirt 70. The liner retainers 74 and/or the lugs 80 can be regularly- or equally-spaced apart around the closure skirt 70.

Each container projection 42 and corresponding lug 80 can be oriented to be parallel to each other; each structure can have the same of different length. The plurality of liner retainers 74 and the plurality of lugs 80 can be spaced the same distances apart and oriented so that each lug 80 is located directly below a liner retainer 74 (or each liner retainer 74 is positioned directly above a lug 80). It is preferred that the distance between each corresponding lug 80 and liner retainer 74 be less than the height 46 of the notches 44.

The second portion 78 of the closure skirt 70 can include one or more stop ribs 86, extensions or protrusions from the interior surface 82 of the second portion 78. Each stop rib 86 can be positioned between neighboring lugs 80 and/or neighboring container projections 42. It is preferred that the stop ribs 86 be located closer to the peripheral rim 84 of the closure skirt 70 than the top panel 52 of the closure 50.

The stop ribs 86 can be disposed axially around the interior surface 71 of the closure skirt 70. The stop ribs 86 can be can be arranged around a circumference of the interior surface 71 of the closure skirt 70. The stop ribs 86 can be regularly- or equally-spaced apart around the closure skirt 70.

Each stop rib 86 can define a structure resembling a ridge, with the ridge oriented to be substantially perpendicular to the top panel 52 and/or peripheral rim 84 of the closure skirt 70. The stop ribs 86 can have flat or substantially flat surfaces. The stop ribs 86 can include surfaces that are curved or angled or have a profile with a triangular shape when viewed in cross-section. The stop ribs 86 can function to engage the spaced-apart projections 42 of the container 20, to limit the distance that the closure 50 can be rotated around the container 20 when the closure 50 and the container 20 are engaged.

Resilient Deformable Liner

Figure 8A:
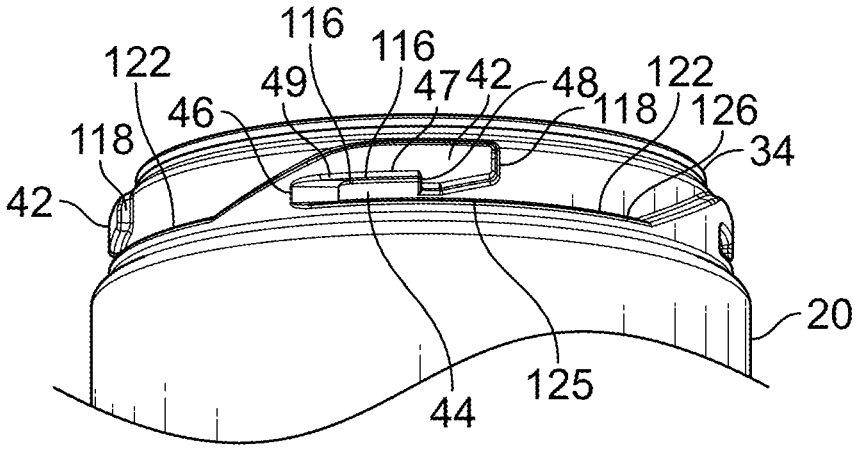
FIGS. 8A-8C show views of a container: respectively, an upward side view, a side view, and a downward side view of the container.
Figure 8B:
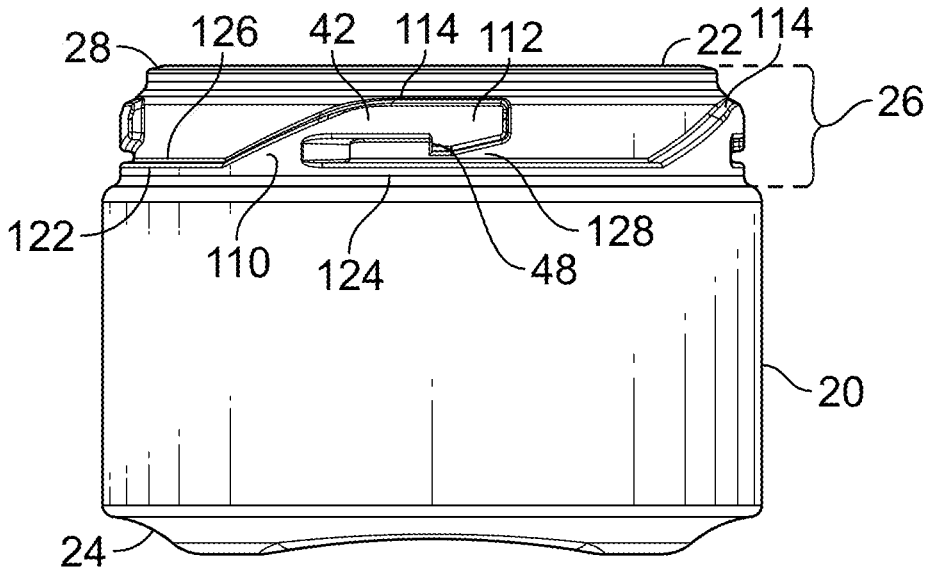
Figure 8C:
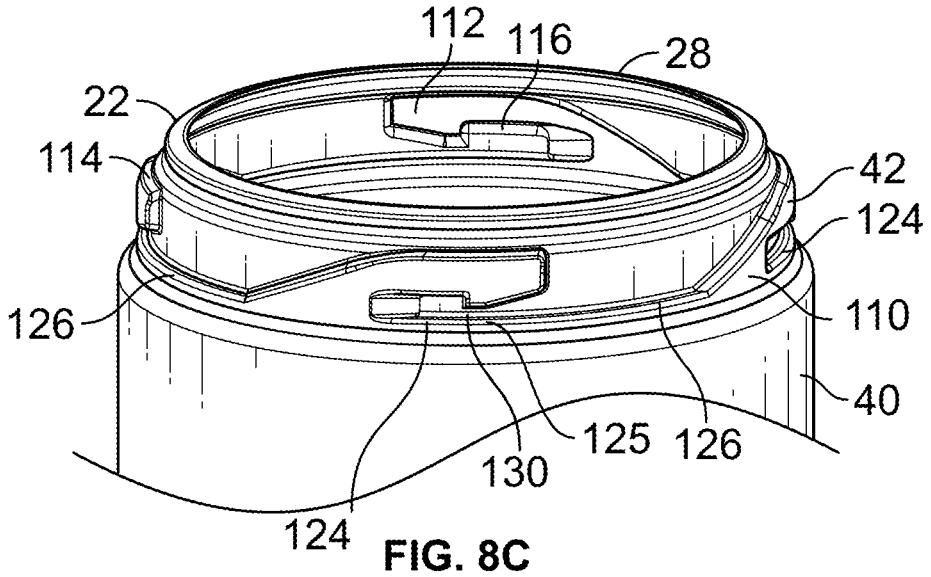
Figure 9A:
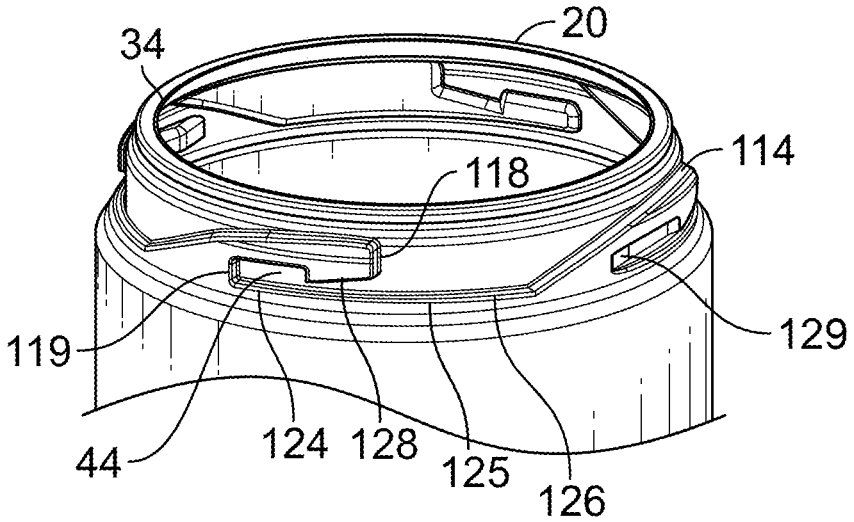
FIGS. 9A-9C show views of the container lugs: respectively, a perspective view, and side views of different types of lugs.
Figure 9B:
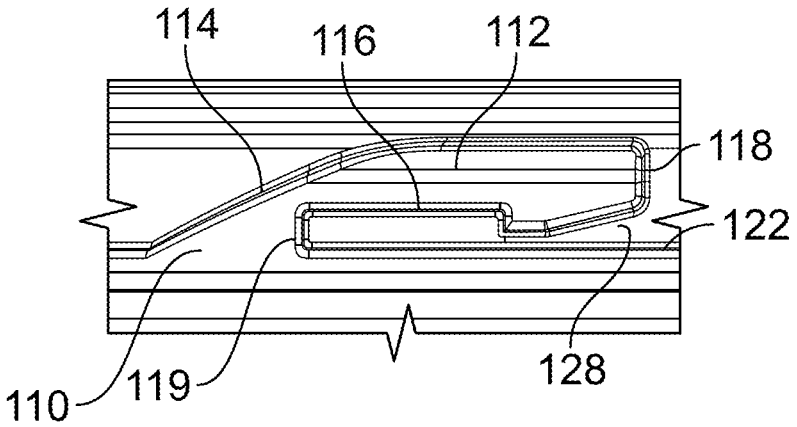
Figure 9C:
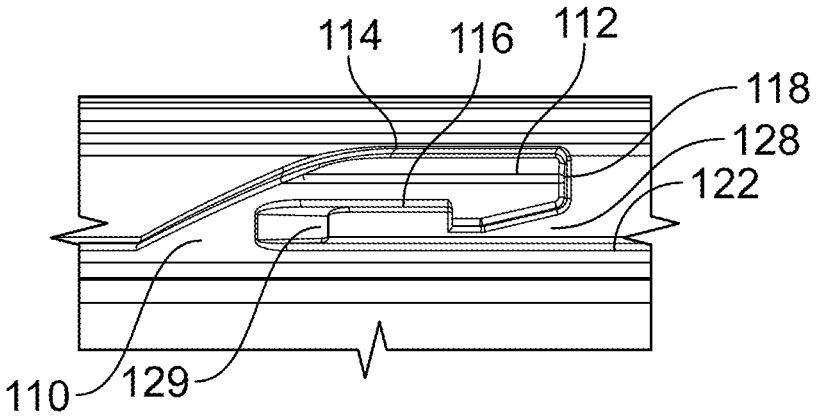

As shown in FIGS. 1 and 8-9, the closure system 10 includes a resilient deformable liner 90 that is positioned between the container 20 and the closure 50. The resilient deformable liner 90 can be a disk of flexible yet resilient material that is cut or shaped to fully cover the mouth 34 of the container 20. The resilient deformable liner 90 can be flat in its native state. A functional resilient deformable liner 90 can have a minimum thickness that is greater than the distance between the bottom of the closure deflection rib 66 and the container finish edge 30 while the closure is in the locked position (held upward). The maximum functional resilient deformable liner 90 can have a thickness matching the gap between the closure interior surface 56 and container nearest corresponding upper surface 98 while the closure is held fully downward as when transitioning to an unlocked configuration.

The resilient deformable liner 90 can have a first, top surface 98 opposite a second bottom surface 99. The resilient deformable liner 90 can include an interior or central portion 96 bounded or surrounded by an exterior portion 92. The exterior portion 92 can be surrounded or bounded by a peripheral edge 94 of the resilient deformable liner 90.

As shown in FIG. 4, when the closure system 10 is in a locked configuration, the resilient deformable liner 90 can adopt a moderately non-flat shape that separates the inner surface 55 of the top panel 52 from the finished edge 28 of the container 20. The resilient deformable liner 90 can remains in a moderately non-flat profile or conformation when the closure system 10 is in the locked configuration. This moderately non-flat profile or conformation of the resilient deformable liner 90 causes a preload force that maintains the closure system 10 in the locked configuration.

In the closed configuration, the top surface of resilient deformable liner 90 can directly contact the deflection rib 66. Preferably, the deflection rib 66 contacts a central portion 96 of the resilient deformable liner 90. The bottom surface of the resilient deformable liner 90 can contact the mouth 34 of the container 20, specifically, the finished edge 28 of the mouth 34. It is preferred that the finished edge 28 contact the outer portion 92 of the resilient deformable liner 90.

In the closed configuration, the resilient deformable liner 90 can contact the inner edge 31 of the finished edge boundary 30, but it is preferred that the resilient deformable liner 90 not contact the outer edge 32 of the finished edge boundary 30 although simultaneous contact of the outer edge 32 and inner edge 31 can be beneficial for some embodiments that require an induction lining operation.

Figure 2:
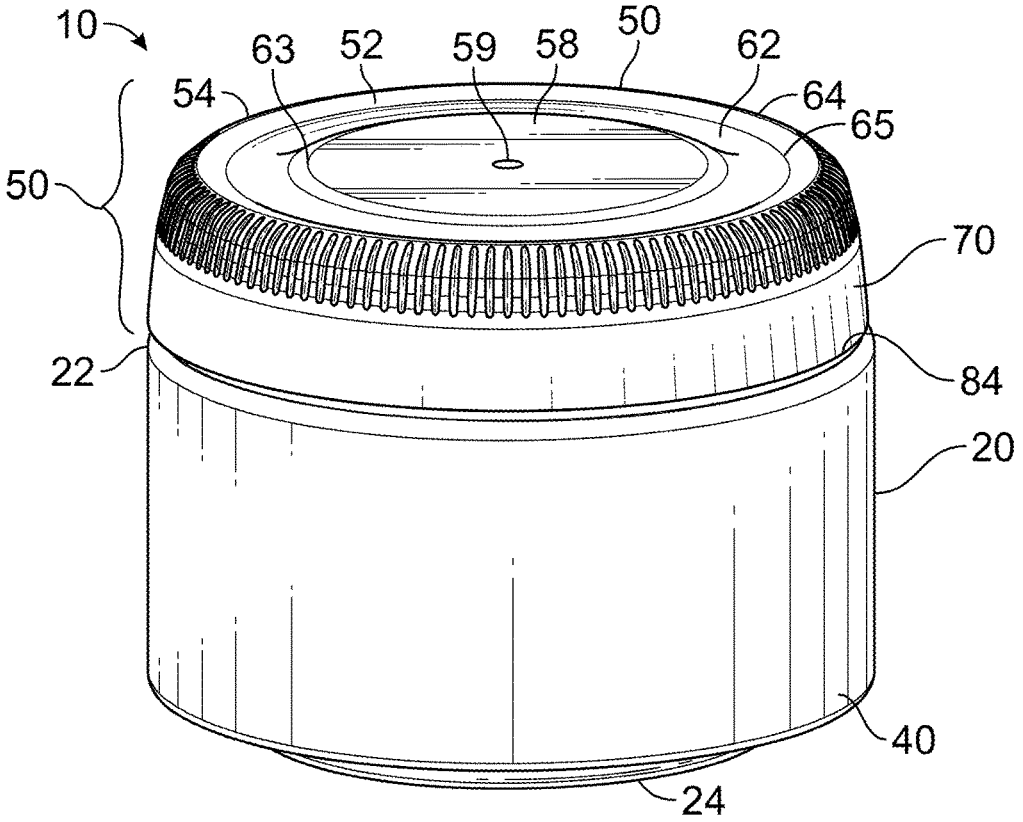
FIG. 2 shows a perspective view of a child-resistant closure system.

As shown in FIGS. 2-3, when the closed configuration, the peripheral rim 84 of the closure skirt 70 is positioned in communication with the top end 22 of the container 20. Preferably, the peripheral rim 84 and the top end 22 are in close communication or contact each other. It is preferred that the peripheral rim 84 and the top end 22 be close enough that the fingers of small children cannot fit between the pieces.

As shown in FIGS. 2-3, it is preferred that the outer diameter or circumference of the closure skirt 70 and the container wall 23 be of the same or similar size.

When the closure system 10 transitions from the locked configuration to an opened or unlocked configuration, the resilient deformable liner 90 can be manipulated by the movement of the container 20 and/or the closure 50 to transition from a moderately or relatively non-flat profile to a strongly curved, angled, or crimped profile, with the liner 90 adopting a profile similar to the depressed and raised portions 62, 64 of the neighboring top panel 52 of the closure 50, as described below.

Adopting the Locked Configuration

When the closure system 10 is placed into the locked configuration, the corresponding locking structures of the closure 50 and container 20 can engage each other. The closure lugs 80 can engage the notches 44 within the container projections 42.

When it is desired to press the closure 50 into locking engagement with the container 20, the Closure 50 containing the resilient deformable liner 90 can be placed atop the mouth 34 of the container 20, so as to cover the opening of the container 20. The resilient deformable liner 90 can be positioned so that the finished edge 28 of the mouth 34 contacts, preferably via direct contact, the surface of the resilient deformable liner 90 (i.e., the bottom surface 99). The resilient deformable liner 90 can be centered over the container mouth 34 and the finished edge 28 can have a continuous connection against the surface of the liner 90. In some embodiments, the resilient deformable liner 90 can form a sealing engagement with the finished edge 28; in other embodiments, the engagement can be less secure and allow the exchange of air, vapor, liquid, or small particles in or out of the container 20. The resilient deformable liner 90 can contact the entire boundary 30 surface of the finished edge 28, or can contact only the inner edge 31 of the boundary 30 of the finished edge 28.

In some embodiments, the finished edge 28 contacts an exterior portion 92 or exterior annular ring of the resilient deformable liner 90, with an interior or central portion 96 of the bottom surface 99 of the resilient deformable liner 90 facing the interior of the container 20. The opposite surface of the liner 90 (i.e., the top surface 98) can face away from the container 20 and toward the soon-to-be-engaged closure 50.

The closure 50 can be positioned so that the interior or inner surface 56 of the top panel 52 and closure skirt 70 communicates with the exterior surface 40 of the top end 22, neck 26, and or mouth 34 of the container 20. The closure 50 can be positioned on the container 20 so that the lugs 80 pass between the projections 42. The closure 50 can then be rotated so that the locking lugs 80 contact the hooked portions 112 of the container projections 42. The stop ribs 86 can contact the outer tip 118 of hooked portions 112, to prevent the lugs 80 from skimming over or past the container projections 42, and guide the lugs 80 toward the inner edges 116 of the hooked portions 112.

The lugs 80 can slide along the hooked portions 112, along the inner hook edges 116 and through the inwardly tapering passageways 128 until the lugs 80 are received within the locking notches 44.

The thickness of the resilient deformable liner 90 can orient or predispose the lugs 80 to rest within the upper portion 45 of the notches 44 (or portion nearest the mouth 34 of the container 20 or furthest from the bottom end 24 of the container 20). The flexural resistant qualities of the resilient deformable liner 90, positioned between the container 20 and the closure 50, position the closure 50 relative to the container 20 so that the notch-occupying lugs 80 cannot engage the inwardly tapering passageways 128 and thus the lugs 80 are unable to disengage from the notches 44 (without the application of additional force).

Alternatively, the lugs 80 can be pushed vertically over the outer edge 114 of the hooked portion 112 of the projection 42 until the lug 80 moves past the inner edge 116 of the hooked portion 112 of the projection 42 to engage the space defined by the notch 44. As soon as the lugs 80 have entered the space defined by the notch 44, the resilient nature of the resilient deformable liner 90 can cause the lugs 80 to gravitate upward, toward the mouth 34 of the container 20 and away from the bottom portion 24 of the container 20, and remain engaged within the notch 44. This engagement of the lugs 80 with the upper edge or side 45 of the notch 44 (or the side of the notch 44 furthest from the bottom end 24 of the container 20 or the side nearest to the mouth 34) prevents the lugs 80 from contacting the bottom edge of the notch 44, and prevents the lugs 80 from contacting the inwardly tapering passageway 128 and exiting the notch 44. As shown in FIGS. 1, 6, and 8-9, a notch 44 can have a rectangular outline or shape with the tapering passageway 128 communicating with a lower corner 48 of the notch 44 (i.e., a corner on the side of the notch 44 closest to the bottom end 24 of the container 20 and/or furthest from the mouth 34 of the container 20.

Once the locking mechanisms of the container 20 and the closure 50 have engaged, the resilient deformable liner 90 is secured between the mouth 34 of the container 20 and the inner surface 56 of the top panel 52 of the closure 50. The resilient deformable liner 90 can maintain its moderately non-flat shape, contacting the container 20 at the finished edge 28 of the container 20 and contacting the closure 50 at the deflection rib 66 and the liner retainers 74.

As described above, an exterior portion 92 of the bottom surface 99 of the resilient deformable liner 90 can contact the finished edge 28 of the container 20. The resilient deformable liner 90 can extend past the finished edge 28 so that the peripheral edge 94 of the resilient deformable liner 90 communicates with the interior surface 71 of the closure skirt 70. The peripheral edge 94 can contact or rest near the interior surface 71 of the closure skirt 70, at a point between the top panel 52 and the liner retainers 74 (e.g., in the first portion 72 of the closure skirt 70). Either the peripheral edge 94 and/or a portion of the exterior portion 92 of the resilient deformable liner 90 can communicate with the finished edge 28 and/or mouth 34 of the container 20

The top surface 98 of the resilient deformable liner 90 can rest near or contact the deflection rib 66 of the top panel 52. As shown in FIGS. 4-5, the deflection rib 66 of the closure 50 can communicate with an interior portion 96 of the top surface 98 of the resilient deformable liner 90, while the finished edge 28 can communicate with the finished edge 28 of the container 20. The deflection rib 66 and the finished edge 28 can simultaneously communicate with different parts of the resilient deformable liner 90, but are positioned to be vertically offset from each other, or so that the deflection rib 66 is not directly in line with the finished edge 28. This vertical offset exceeds the thickness of the resilient deformable liner 90 which causes the resilient deformable liner 90 to have a predisposed deflection while in the locked configuration which imposes a preload force holding the locked configuration secure.

The peripheral edge 94 of the resilient deformable liner 90 can be supported, buttressed, or retained by the projecting surfaces of the liner retainers 74 in the closure skirt 70 to maintain a connection between the Closure 10 and the resilient deformable liner 90 facilitating subsequent reapplications.

Thus, the closure system 10 can adopt and maintain a locked configuration until a user or consumer chooses to unlock or disengage the closure system 10.

Disengaging from the Locked Configuration

When the closure system 10 transitions from the locked configuration to an unlocked configuration, the movement of the closure 50 toward the container 20 (or vice-versa) causes the resilient deformable liner 90 to deform. The deformation of the resilient deformable liner 90 allows the closure 50 and container 20 to move with respect to each other so that their locking mechanisms (i.e., projections 42 and lugs 80) can disengage, thus allowing the closure 50 and container 20 to disengage and separate from each other.

The locked closure system 10 can be unlocked or opened from the locked configuration by pushing the closure 50 toward the container 20 for a minimum distance, also called a push distance or transition distance 15. That distance must be sufficient to move the lugs 80 so that they contact the juncture of the inwardly-tapering passageway 128 and the notch 44. Depending on the initial position of the lugs 80, the lugs 80 can be guided directly to the bottom edge of the notch 44 and rotated axially until they contact the inwardly-tapering passageway 128, and then the lugs 80 can exit the notch 44 and the closure 50 can be disengaged from the container 20. In some circumstances, the lug 80 can be initially positioned along an edge of the notch 44 until a combination of axial rotation and pushing movement directs the lug 80 to the tapering passageway 128, where it can exit the notch 44.

The closure 50 can then be removed from locking engagement with the container 20 by pressing or moving the closure 50 in an axial direction relative to the container 20 to thereby direct the locking lugs 80 from the upper portions of the locking notches 44 (or portion furthest from the bottom end 24 of the container 20 or nearest the mouth 34 of the container 20) and into the inwardly-tapering passageways 128. The closure 50 can then be removed from the container 20 by rotating it sufficiently to allow the locking lugs 80 to pass between the projections 42 and then lifting the closure 50 from the container 20.

When the closure 50 is moved or pushed toward the container 20 for a distance equal to or greater than the transition distance 15, certain structures of the closure 50 and container 20 can act in concert to change the configuration of the resilient deformable liner 90 in such a way as to allow the container 20 and closure 50 to move closer together, which in turn enable the lugs 80 to engage with the tapering passageways 128 and exit from the notches 44 of the container projections 42.

Specifically, the deflection rib 66 can engage the central portion 96 of the resilient deformable liner 90, causing the portion of the resilient deformable liner 90 surrounded by the deflection rib 66 to move away from the top panel 52 of the closure 50, through the mouth 34, and into the interior of the container 20.

Preferably contemporaneously, the depressed and raised portions 62, 64 of the top panel 52 can move toward the resilient deformable liner 90 and contact or engage portions, even continuous portions, of the upper or top surface 98 of the resilient deformable liner 90, causing the resilient deformable liner 90 to change from a moderately non-flat configuration to a much more curved or angled surface, adopting a profile similar to that of the top panel 52. That is, the resilient deformable liner 90 can transition from having a moderately non-flat profile to a sinuous, snakelike, wavy, crimped, rippled, or highly non-flat profile (or profile having multiple curves resembling a sine wave or profile having multiple angles), where different portions have different elevations.

At this time, the deflection rib 66 can deform a central portion 96 of the liner 90, and the highly curved portions (i.e., 62, 63) of the top panel 52 can engage the mouth 34 of the container 20; these action can cause an outer portion 92 of the liner 90 to contact the highly curved portions of the top panel 52 and transition to a highly curved profile mimicking the profile of the top panel 52.

As the closure 50 moves toward the container 20, a greater portion of the bottom surface 99 of the resilient deformable liner 90 can engage the finished edge 28. The bottom surface 99 can change from engaging only or mostly the inner edge 31 of the boundary 30 of the finished edge 28, to contacting an increased surface area of the boundary 30. The bottom surface or lower 99 can preferably contact most or all of the area between the inner and outer edges 31, 32 of the boundary 30 of the finished edge 28.

Where the finished edge 28 has an acute angle, the angled finished edge 28 can reinforce the curved or angle profile imposed on the resilient deformable liner 90 as it is increasingly engaged between the raised portion 64 of the top panel 52 and the finished edge 28.

Where the finished edge 28 has an obtuse angle, the angled finished edge 28 can reinforce the curved or angle profile imposed on the resilient deformable liner 90 as it is increasingly engaged between the depressed portion 64 of the top panel 52 and the finished edge 28. As a result, the resilient deformable liner 90 can be caused to adopt a profile resembling or paralleling that of the portions of the top panel 52 in communication with the upper or top surface 98 of the resilient deformable liner 90.

While being unlocked, the resilient deformable liner 90 can transition from a moderately non-flat profile to a strongly curved, angled, crimped or highly non-flat profile, with the liner 90 adopting a profile similar that of the inner surfaces 55, 71 of the neighboring top panel 52 of the closure 50.

The individual components of the closure system 10 can be manufactured by various molding methods such as blow molding the container 20, injection molding the closure 10, or extruding the resilient deformable liner 90 or by any method commonly used to make components of closure systems.

Specific embodiments of a child-resistant closure system according to the present invention have been described for the purpose of illustrating the manner in which the invention can be made and used. It should be understood that the implementation of other variations and modifications of this invention and its different aspects will be apparent to one skilled in the art, and that this invention is not limited by the specific embodiments described. Features described in one embodiment can be implemented in other embodiments. It is understood to encompass the present invention and any and all modifications, variations, or equivalents that fall within the spirit and scope of the basic underlying principles disclosed and claimed herein.

What is claimed is:

1. A child-resistant closure system comprising:

a container having:

a neck on a first end of the container, the neck having a finished edge defining an annular mouth, and a plurality of spaced-apart projections extending outward from an outer surface of the neck, each neck projection including a hook-shaped portion defining a notch in the interior of the projection, a portion of each notch adjoining a narrower end of a tapering passageway;

a closure having a top panel and a skirt depending from a periphery of the top panel, the top panel including a central portion, an annular depressed portion surrounding the central portion, and an annular raised portion surrounding the depressed portion, the central portion having an annular deflection rib extending inward from an interior surface of the central portion;

the closure skirt having, respectively, a first portion containing a plurality of spaced-apart liner retainers extending inward from an interior surface of the first portion, each liner retainer defining a ledge, a second portion containing a plurality of spaced-apart lugs extending inward from the interior surface of the central portion, the lugs adapted to engage the notches in the projections on the container, and a peripheral rim; and a resilient deformable liner positioned between the container and the closure, having:

an interior portion for communicating with the annular deflection rib when the closure system is in a locked configuration, an exterior portion for communicating with the finished edge of the container neck when the closure system is in the locked configuration, and a peripheral edge;

wherein when the closure system is in the locked configuration, the lugs are engaged within the notches in the projections on the container, and the resilient deformable liner adopts a moderately non-flat profile and engages the finished edge; and wherein when in the locked configuration, when sufficient force is applied for the top panel and the finished edge to engage the resilient deformable liner therebetween, the resilient deformable liner is increasingly deformed as it contacts the depressed and raised portions of the top panel, and the lugs are moved such that they can exit the notches through the tapering passageways.

2. The child-resistant closure system of claim 1, wherein the first portion of the closure skirt comprises a plurality of stop ribs extending inward from the interior surface of the first portion, each stop rib communicating with a corresponding projection when the closure system is in the locked configuration.

3. The child-resistant closure system of claim 1, wherein the finished edge angles inward and toward the closure.

4. The child-resistant closure system of claim 2, wherein the angle between the finished edge and the neck is less than 45 degrees.

5. The child-resistant closure system of claim 1, wherein the liner retainers extend inward from the closure skirt for a distance between 1/64 of an inch and 4/64 of an inch.

6. The child-resistant closure system of claim 1, wherein the closure system container is manufactured by blow molding.

7. The child-resistant closure system of claim 2, wherein the annular deflection rib defines a ring surrounding the central portion, and a diameter of the deflection rib is smaller than a diameter of the mouth of the container.

8. A child-resistant closure system comprising:

a container having:

a mouth, the mouth surrounded by a finished edge, and a plurality of spaced-apart projections extending outward from an outer surface of the container, each projection having:

an interior surface defining a notch within the projection, and an exterior surface defining a side of a tapering passageway, the tapering passageway connecting the notch to an exterior surface of the projection;

a closure having a top panel and a skirt depending from a periphery of the top panel, the top panel including a central portion, a groove disposed around the central portion, and a ridge disposed around the concave portion, the central portion having an deflection rib extending inward from an interior surface of the central portion;

the closure skirt having:

a first portion containing:

a plurality of spaced-apart liner retainers extending inward from an interior surface of closure skirt, and a plurality of stop ribs extending inward from the interior surface of the first portion, each stop rib for communicating with a corresponding projection when the closure system is in a locked configuration;

a second portion containing a plurality of spaced-apart lugs extending inward from the interior surface of the central portion, the lugs adapted to engage the notches in the projections on the container; and a resilient deformable liner positioned between the container and the closure having, respectively:

an first surface contacting the deflection rib, a second surface contacting the finished edge of the container, and a peripheral edge;

wherein the closure system adopts the locked configuration, the lugs are engaged within the notches in the projections on the container, and the liner contacts the closure primarily at the deflection rib; and wherein when the closure system adopts an unlocked configuration by a pushing movement applied to the closure so that the peripheral edge and the ridge engage the resilient deformable liner therebetween, the pushing engagement causing: the deflection rib to deform a central portion of the deformable liner, the peripheral edge of the resilient deformable liner to become more distant from the liner retainers, and a portion of the liner to contact the raised and depressed portions of the closure; and the pushing movement allowing the lugs to disengage from the notches through the tapering passageways for separating the closure from the container.

9. The child-resistant closure system of claim 8, wherein the finished edge includes an angled upper surface having an inner edge and an outer edge, the inner edge of the angled upper surface contacting the resilient deformable liner when the closure system is in the locked configuration, and both edges contacting the resilient deformable liner when the closure system adopts the unlocked configuration.

10. The child-resistant closure system of claim 9, wherein the finished edge forms an acute angle in relation to a plane defined by the mouth.

11. The child-resistant closure system of claim 9, wherein:

the deflection rib defines a ring surrounding a center of the central portion; and a diameter of the deflection rib is smaller than a diameter of the mouth of the container.

12. The child-resistant closure system of claim 9, wherein the liner retainers extend inward from the closure skirt for a distance between 1/64 of an inch and 4/64 of an inch.

13. The child-resistant closure system of claim 9, wherein when the closure system transitions from the locked configuration to the unlocked configuration, the resilient deformable liner adopts a profile with multiple curves.

14. A child-resistant closure system comprising:

a container having:

a mouth defined by a finished edge, and a plurality of spaced-apart projections extending outward from an outer surface of the container, each projection defining an indentation;

a closure having a top panel and a skirt depending from a periphery of the top panel, the top panel including a central portion, a concave portion disposed around the central portion, and a convex portion disposed around the concave portion, the central portion having an deflection rib extending inward from an interior surface of the central portion;

the closure skirt having:

a first portion communicating with the top panel, the first portion containing a plurality of spaced-apart circumferential liner retainers extending inward from an interior surface of closure skirt, and a second portion containing a plurality of spaced-apart circumferential lugs extending inward from the interior surface of the central portion, the lugs adapted to engage the indentations in the projections on the container; and a resilient deformable liner positioned between the container and the closure having:

a first surface facing the top panel, a second surface facing the mouth of the container, and a peripheral edge extending past the mouth;

wherein when the closure system is in a locked configuration, the lugs are engaged within the indentations in the projections on the container, the first surface contacts the deflection rib, and the peripheral edge no longer engages the liner retainers; and wherein the closure system transitions from the locked configuration to an unlocked configuration by moving the top panel toward finished edge for a transition distance, so that a) the deflection rib moves a central portion of the resilient deformable liner into the mouth of the container, b) the resilient deformable liner becomes more distant from the liner retainers, c) a portion of the resilient deformable liner contacts the concave and convex portions of the closure; and d) the lugs move from the indentations to the tapering passageways, for disengaging the closure from the container.

15. The child-resistant closure system of claim 14, wherein the finished edge includes an angled surface having an inner edge and an outer edge, the inner edge of the angled upper surface contacting the resilient deformable liner when the closure system is in the locked configuration, and both edges contacting the resilient deformable liner when the closure system adopts the unlocked configuration.

16. The child-resistant closure system of claim 14, wherein in the locked configuration, the liner retainers do not contact the mouth of the container.

17. The child-resistant closure system of claim 14, wherein when the closure system is in the locked configuration, the resilient deformable liner adopts a moderately non-flat configuration.

18. The child-resistant closure system of claim 14, wherein the deflection rib defines a ring surrounding a center of the central portion.

19. The child-resistant closure system of claim 14, wherein the first portion of the closure skirt comprises a plurality of stop ribs extending from the interior surface of the first portion, each stop rib communicating with a corresponding projection when the closure system is in the locked configuration, and each stop rib disengaging from the corresponding projection when the closure system is in the unlocked configuration.

20. The child-resistant closure system of claim 14, wherein the indentations have a height and a length; and the transition distance is greater or equal to the indentation height.

* * * * *